United States Patent [19]

Schiffer

[11] Patent Number: 4,953,066

[45] Date of Patent: Aug. 28, 1990

[54] LIGHT ASSEMBLY FOR LIQUID ENVIRONMENT

[76] Inventor: Mike Schiffer, 8397 Rural, Boca Raton, Fla. 33433

[21] Appl. No.: 399,221

[22] Filed: Aug. 28, 1989

[51] Int. Cl.[5] ..... F21P 1/00; G09F 13/28

[52] U.S. Cl. ..... 362/252; 40/550; 362/267; 362/293; 362/310; 362/812

[58] Field of Search ..... 362/252, 267, 293, 310, 362/812; 40/550, 551, 552

[56] References Cited

U.S. PATENT DOCUMENTS

| | | | |
|---|---|---|---|
| 1,820,086 | 8/1931 | Naylor | 40/550 |
| 1,987,863 | 1/1935 | Murphy | 40/551 |
| 4,439,818 | 3/1987 | Scheib | 362/252 |
| 4,709,307 | 11/1987 | Branom | 40/550 |
| 4,839,777 | 6/1989 | Janko | 362/252 |
| 4,843,527 | 6/1989 | Britt | 40/550 |

FOREIGN PATENT DOCUMENTS

| | | | |
|---|---|---|---|
| 499896 | 11/1954 | Italy | 40/550 |

*Primary Examiner*—Douglas Hart

[57] ABSTRACT

A lighting assembly comprising a plurality of light fixtures each including a light source such as an electric bulb disposed on the interior of an elongated sleeve which is sealed from the entrance of water therein and further wherein the plurality of light fixtures are preferably mounted on a base in a predetermined array configured in the form of alphabetical letters or any other utilitarian or decorative format.

15 Claims, 1 Drawing Sheet

FIG. 1
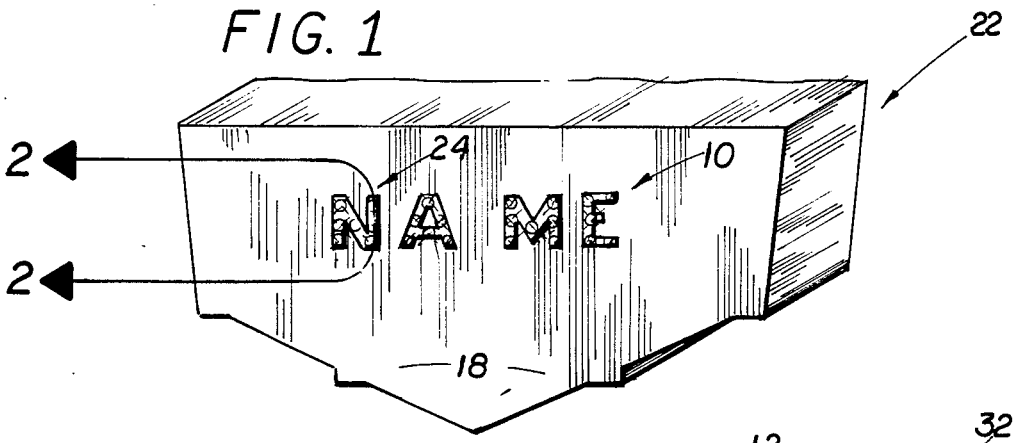
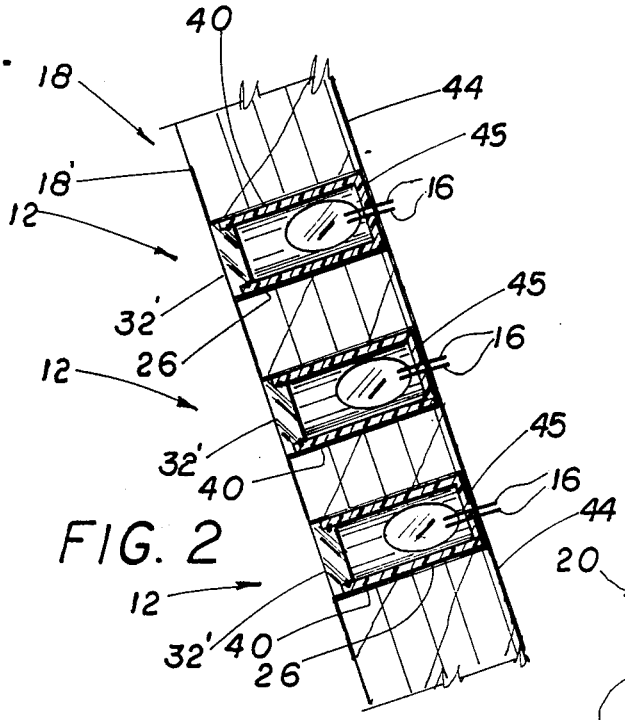
FIG. 2
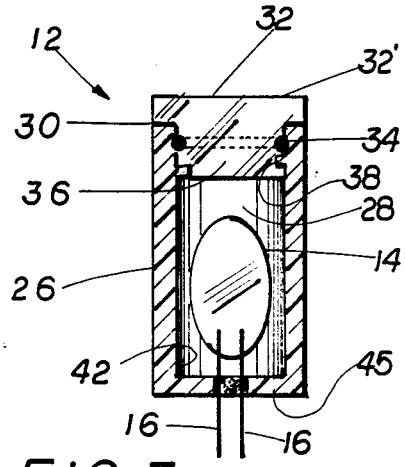
FIG. 3
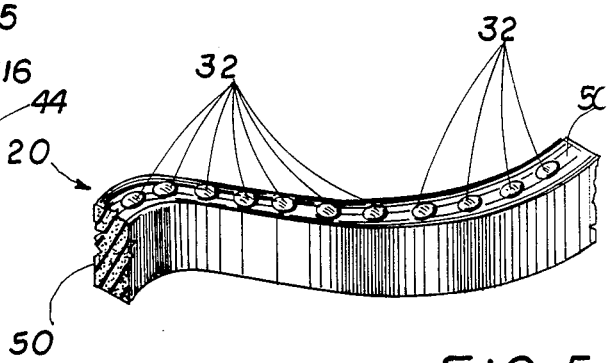
FIG. 5
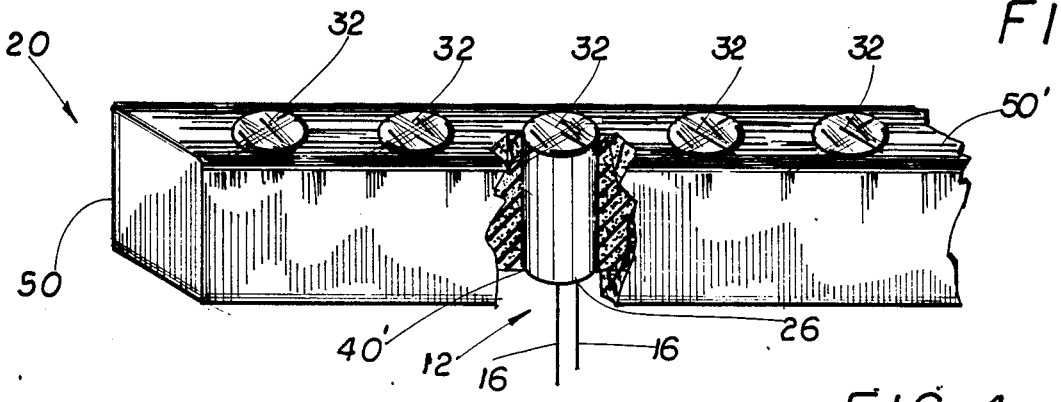
FIG. 4

LIGHT ASSEMBLY FOR LIQUID ENVIRONMENT

BACKGROUND OF THE INVENTION

1. Field of the Invention

This invention relates to a lighting assembly comprising a plurality of light fixtures which may be collectively arranged in a decorative or utilitarian array for purposes of illumination or outlining alphabetical letters to emphasize words, names, etc.

2. Description of the Prior Art

Numerous lighting assemblies are available wherein signs, names, words, etc. are accentuated in a sign structure through the provision of a plurality of light bulbs collectively arranged in an array which outlines the various letters of the name, word, etc. Typically, such lighting fixtures or assembly are generally somewhat similar to a "Christmas Tree" lighting assembly wherein a plurality of sockets are arranged in series or parallel interconnection by electrical conductors and connected to a power source by any applicable, conventional connectors such as a wall plug or the like.

While the above concept is utilized extensively and evidenced throughout the prior art, no such lighting assembly is specifically adapted and structured for use in an environment where access or exposure to water or liquid is prevalent. It is obvious that conventional lighting systems of the type referred to above cannot readily be adapted for use in such relatively harsh environments. To the contrary, specific structural features or changes have to be made to accomplish use of such an assembly on boats or other marine craft or in areas such as bathrooms or the like where exposure of the lighting system to water is common.

The structures disclosed in the following U.S. Patents are indicative of prior art lighting systems of the type generally set forth above. Reed, U.S. Pat. No. 2,131,671, discloses an illuminated display sign wherein a plurality of sockets, each intended to receive a miniaturized light bulb therein, are interconnected by conventional conductors. The lighting assembly, is designed primarily for an illuminated display sign structure. Peterson, U.S. Pat. No. 813,580, also discloses a sign wherein a specific letter of a word is at least partially structured by a plurality of spaced apart electrically powered bulbs arranged in an outline of the specific letter. Similarly, Naylor, U.S. Pat. No. 1,820,086, discloses a similar sign structure but further adds the mounting structure or features associated therewith for each of the individual light bulbs or light fixtures.

The patent to Boesen, U.S. Pat. No. 4,234,914, discloses an incandescent display system suitable for use in displaying video images and utilizing a plurality of incandescent lamps positioned closely to each other in order to effect a high resolution picture. Removal of the individual lamps for purposes of servicing the light is possible through the structure in which they are mounted.

The patent to Murphy, 1,987,863, discloses a variable sign primarily designed for use in a highway or railroad application and which may be provided in standard shapes and be readily assembled in the field according to the particular object being marked. Murphy does show the housing or mounting of individual lenses 14 within a lens pocket by means of a ferrule 15 of lead or similar material inserted around the lens. Pocketed projections extend rearwardly and are equipped with electric lamp sockets 20 and lenses 21 for the operative securement of the light bulb or illumination source. However, no ceiling effect is provided.

Based on the above, there is obvious need in the light industry for a light assembly which is specifically adapted for use in combination with marine craft or other locations wherein a given lighting assembly or fixture is commonly exposed to water or liquid and which operates under a low voltage and further, wherein the light bulb or the light source is protected from such exposure to prevent damage or deterioration of the lighting circuit.

SUMMARY OF THE INVENTION

The present invention relates to a light assembly of the type comprising a plurality of lighting fixtures. The fixtures are mounted on a base in an array having one of a variety of configurations. More specifically, a predetermined configuration in which the plurality of fixtures may be disposed may very well represent an alphabetical letter of a word or name. Because of this versatility, the subject lighting assembly is well adapted for use in illuminating or effectively "highlighting" the name on a boat, ship or like marine craft or other vehicle or like structure. Structural features associated with the present invention are particularly adapted for use in an environment which is readily exposed to water, liquid or the like.

In the aforementioned embodiment, the base on which the plurality of fixtures are located may be the transom portion of a boat, ship, etc. wherein the plurality of fixtures are mounted on the base in a manner which outlines each of the alphabetical letters representing a name. Therefore, one viewing the boat and particularly the transom will effectively see the name of the boat illuminated clearly. Such name or other words on the boat can be used for utilitarian purposes such as the illumination of a name or message or may be used purely for a decorative feature to the extent that the plurality of the light fixtures may be arranged in any type of decorative or aesthetically pleasing design.

In another embodiment of the present invention to be described in greater detail hereinafter, the base in which the various fixtures are located may be an elongated flexible material strip such as rubber, plastic or the like wherein the strip has sufficient flexibility to be folded, bent or otherwise curved relative to its own normally linear longitudinal axis. In this fashion, one or more of the elongated strips defining the base of the second embodiment may be positioned at various locations such as in bathrooms, under or about bathtubs or in surrounding relations to sinks or other areas which may be readily exposed to water and where desired to add decorative or functional lighting to the given area. Naturally, decorative lighting using the flexible strip base of the above mentioned embodiment may be utilized extensively on marine craft for decorative rather than utilitarian purposes.

An important structural feature of the present invention is the structure of the individual ones of the plurality of light fixtures which enable an electrically powered light bulb to be housed or mounted within the base in a manner which ensures its isolation from the water, liquid or the like, yet renders it accessible for repair or replacement and also, facilitates the mounting of such fixtures in a variety of locations varying from marine craft to flexible lighting strips as set forth above.

While the structure of the present invention has been emphasized for use in a water or liquid exposed environment, it is, of course, not limited to such an environment but may be used in any location where a light assembly of the type set forth herein is desired.

BRIEF DESCRIPTION OF THE DRAWINGS

For a fuller understanding of the nature of the present invention, reference is had to the following detailed description taken in connection with the accompanying drawings in which:

FIG. 1 is front plan view of the stern of a marine craft or the like.

FIG. 2 is a sectional view of a plurality of light fixtures of the present invention mounted on the base and taken along line 2—2 of FIG. 1.

FIG. 3 is a detailed sectional view of a single light fixture.

FIG. 4 is a perspective view in partial cut-away of another embodiment of the present invention.

FIG. 5 is a perspective view in partial cut-away of the embodiment of FIG. 4 shown in a curvilinear or other than straight line configuration.

Like reference numerals refer to like parts throughout the several views of the drawings.

DETAILED DESCRIPTION OF THE PREFERRED EMBODIMENT

As shown in FIGS. 1 through 4, the present invention is directed to a lighting assembly generally indicated as 10 and including a plurality of fixtures each generally represented as 12 (see FIG. 3). Each of the fixtures include an electrically powered light bulb 14 which may vary in size, shape, configuration and which may be of the type commercially available. It is further to be emphasized that the lighting assembly of the present invention, specifically when used in a liquid or water exposed environment such as on a marine craft or the like, can be used with a low voltage power source to prevent harm through electrical shock in the event the circuitry is exposed to water. The light bulbs are arranged in directly interconnected relation to one another by a plurality of conductors as at 16 and each are collectively and concurrently connected to an electrical power source through any type of connector such as a wall plug or the like. While not specifically shown, it is to be understood that in addition to the light bulbs 14, a receiving socket such as the twist type connection socket may be also mounted in or a part of each of the plurality of fixtures 12. The plurality of fixtures 12 are therefore arranged in a "lighting string" type of structure. Each of the fixtures 12 are intended to be mounted in a base of the type represented as 18 in FIGS. 1 and 2 and of the type represented generally as 20 in the embodiment of FIG. 4.

FIGS. 1 and 2 represent the base 18 being the transom or other applicable portion of a boat generally indicated as 22. Particularly in the embodiment of FIG. 1, the plurality of light fixtures are arranged collectively in the form of one or more alphabetical letters as at 24 so as to effectively illuminate the outline of the letter 24, thereby making it more noticeable during the evening hours or under poor lighting conditions as well as adding to the overall aesthetic appearance of the name as clearly shown in FIG. 1. Further, in the embodiment of FIGS. 1 and 2, the base 18, representing the transom portion of the marine craft 22, is substantially rigid and may be formed from any variety of materials from which the marine craft is made such as but not limited to fiberglass.

Further, with regard to FIG. 3, each of the fixtures 12 include an elongated hollow sleeve 26 having a hollow interior portion as at 28 in which the electric lamp or bulb 14 is housed. An outer or first end of the sleeve 26 is normally or initially opened as at 30 but is covered by a light emitting cover structure 32 which may serve as a closure in overlying, covering relation to the open end 30 of the sleeve 26. Also, in order to clearly emit light from the lamp 14, once it is illuminated, the cover structure 32 may be formed from a transparent or translucent material so that the light will clearly emanate there through from the interior 28. Further, the cover structure 32 may be made from a material of varying color so as to further enhance the aesthetic appearance of the illumination emanating from the cover structure 32. In order to ensure that water will not inadvertently pass into the interior 28 of the sleeve 26, the cover structure 32 is sealed in covering relation to the opening 30 of the first end of the sleeve 26. Such liquid tight sealing may take a variety of forms including but not limited to a specific o-ring type seal 34 mounted on or secured to interior peripheral surfaces of the inner portion 36 of the cover structure 32. Further, the cover structure 32 may be removably disposed in its covering relation and secured therein by some type of locking key and key way arrangement or internal and external threads as at 38.

In order to mount the individual fixtures 12 in the base 18, a plurality of channels 40 are drilled or otherwise formed in the base. The channels are of sufficient interior dimension to allow passage and/or securement of the sleeves 26 therein. The sleeves 26 may be longitudinally dimensioned such that the second or opposite end of the sleeves as at 42 register with the inner surface 44 of the base 18 as shown best in FIG. 2. The sleeves may be initially closed during their formation by an integral closed second end as at 45 or may have a fiberglass, gel coat or any other like sealing material coating applied over the second end 42 over surface 44 as shown. In either case, the conductors 16 pass through the second end 42 so that they may accomplish interconnection with the conventional electrical power source (not shown for purposes of clarity).

As shown in FIG. 5, the base 20 includes an elongated strip like structure 50 formed of an elastic and/or flexible material including sufficient flexibility to be at least partially bent relative to its normal, linear longitudinal axis. This flexibility allows it to be adapted to many configurations and placed in a variety of locations in elongated strips. In each embodiment, the fixtures 12 are structured the same to include the sleeve 26 housing the electric lamp or light bulb 14 as described in detail with reference to FIG. 3. When referring to the base 50, elongated channels 40' may be formed therein similar to the channels 40 in the base 18 of the embodiment of FIG. 2. In either embodiment of FIGS. 2 and 4, it is preferred that the outer most exposed surface of cover 32 as at 32' is in co-planar or aligned registry with the outer exposed surface 50' of the embodiment of 54 and 18' of the preferred embodiment as shown in FIG. 1.

Now that the invention has been described, what is claimed is:

1. A lighting assembly for use in a liquid exposed or other applicable environment, said assembly comprising:

(a) a plurality of light fixtures each connected to a source of electrical power, (b) a base means structured for support of said plurality of light fixtures in predetermined, spaced relation to one another, (c) said plurality of light fixtures collectively disposed in an array of predetermined configuration, (d) each of said light fixtures comprising a sleeve having a first end structured to emit light therefrom and a light source mounted within said sleeve in cooperative relation to said first end so as to direct light therethrough;

(e) each of said sleeves including a closed second end and conductor means connected thereto for electrical interconnection between the respective light source and the source of electrical power, said second end being permanently closed and sealed by a sealing structure applied thereto, (f) each of said sleeves disposed to position said first end in adjacent relation to an outer exposed surface of said base means so as to direct light outwardly from said exposed surface, and (g) a cover structure removably mounted in overlying, covering relation to an access opening defined at said first end and formed from a light transmitting material.

2. An assembly as in claim 1 wherein said light transmitting material is transparent.

3. An assembly as in claim 1 wherein said light transmitting material is translucent.

4. An assembly as in claim 3 wherein said translucent material may comprise any one of a plurality of varied colors.

5. An assembly as in claim 1 wherein said cover structure is secured in liquid tight, sealing engagement with said first end, whereby liquid is prevented from entering said sleeve through said cover structure.

6. An assembly as in claim 1 further comprising a seal means disposed in liquid sealing engagement between said cover structure and said first end of said sleeve.

7. An assembly as in claim 1 wherein said sealing structure comprises a coating of fiberglass material.

8. An assembly as in claim 1 wherein said sealing structure comprises a coating of gel coat material.

9. An assembly as in claim 1 wherein said base means comprises an at least semi-rigid material and said plurality of light fixtures are formed at least partially on the interior thereof.

10. An assembly as in claim 9 wherein said base means comprises the plurality of channels integrally formed therein in communicating relation with the outer exposed surface thereof, each of said sleeves mounted within one of said channels and positioned to orient said first end in communicating relation with the outer exposed surface of said base means.

11. An assembly as in claim 1 wherein said base means is formed of a flexible material capable of being bent at least partially along its own length.

12. An assembly as in claim 11 wherein said base means comprises an elongated configuration including one exposed surface, each of said light fixtures mounted on said base means to orient respective ones of said first ends along said one exposed surface.

13. An assembly as in claim 10 wherein said base means comprises a plurality of channels integrally formed therein in communicating relation with the outer exposed surface thereof, each of said sleeves mounted within one of said channels and positioned to orient said first end in registry with the outer exposed surface of said base means.

14. An assembly as in claim 1 wherein said plurality of lights are collectively oriented into said array of predetermined configuration defined by the shape of at least one letter of the alphabet.

15. An assembly as in claim 13 wherein said plurality of lights are collectively oriented in said array of predetermined configuration defined by a plurality of spaced apart letters of the alphabet.

* * * * *